US005217320A

United States Patent [19]

Cioffi

[11] Patent Number: 5,217,320

[45] Date of Patent: Jun. 8, 1993

[54] VEHICLE MOUNTED VIBRATING TAMPER

[76] Inventor: Dominic A. Cioffi, 44245 State Rte. 14, Columbiana, Ohio 44408

[21] Appl. No.: 807,193

[22] Filed: Dec. 16, 1991

[51] Int. Cl.[5] ..... E01C 19/38; E01C 19/40

[52] U.S. Cl. ..... 404/133.2; 404/102

[58] Field of Search ..... 404/133.05, 133.2, 102, 404/84.1, 85, 120, 113, 83; 180/41, 306; 280/240, 400

[56] References Cited

U.S. PATENT DOCUMENTS

| | | | |
|---|---|---|---|
| 2,951,427 | 9/1960 | Moir . | |
| 3,217,620 | 11/1965 | Mindrum et al. | 404/133.05 |
| 3,376,799 | 4/1968 | Perry et al. . | |
| 3,636,833 | 1/1972 | Lowen | 404/133.05 X |
| 3,914,065 | 10/1975 | Domenighetti | 404/128 |
| 4,005,944 | 2/1977 | Harris | 404/133.05 |
| 4,073,592 | 2/1978 | Godberson | 404/82 |
| 4,082,471 | 4/1978 | Hiszpanski | 404/133.1 |
| 4,568,218 | 2/1986 | Orzal | 404/117 |
| 4,634,311 | 1/1987 | Jinnings et al. | 404/133.05 |
| 4,655,636 | 4/1987 | Domenighetti | 404/133.05 |
| 4,676,689 | 6/1987 | Yant | 404/133.2 |
| 4,735,523 | 4/1988 | Ishikawa et al. | 404/133.2 |
| 4,826,356 | 5/1989 | Bec et al. | 404/133.2 |

*Primary Examiner*—Ramon S. Britts
*Assistant Examiner*—Nancy P. Connolly
*Attorney, Agent, or Firm*—Harpman & Harpman

[57] ABSTRACT

A vehicle mounted vibrating tamping device for attachment to a support vehicle having an attenuated extensible boom to pre-position a vibrating multiple fixture head against a work surface. The tamping device is self-contained independently controlled for selective loading force on the work surface and interconnects with the hydraulic system of the vehicle.

8 Claims, 3 Drawing Sheets

VEHICLE MOUNTED VIBRATING TAMPER

BACKGROUND OF THE INVENTION

1. Technical Field

This device relates to impact and maintenance type machinery that is used for compaction and aggregate preparation usually associated with road maintenance and the like. Such devices are typically attached to maintenance vehicles and usually have compaction or tamping features associated therewith.

2. Description of Prior Art

Prior art devices have relied on a number of different designs to support, extend and manipulate tamping and roller heads against a work surface, see for example U.S. Pat. Nos. 2,951,427, 3,376,799, 3,217,620 and 4,005,944.

In U.S. Pat. No. 2,951,427 a road working machine is disclosed having a pair of pivoted arm structures with a vibrating tamping shoe connected therebetween.

U.S. Pat. No. 3,376,799 discloses an impact machine having a compaction shoe carried by a plunger movably positioned in a housing. A cam and connector rod assembly is used with an hydraulic motor to impart reciprocal oscillations to a hammer connected to the plunger. This device is mountable on the end of a backhoe.

U.S. Pat. No. 3,217,620 shows a road maintenance apparatus which has a rotatable multiple tool head positioned on an adjustable arm extending outwardly from the maintenance truck. Different tools can be rotated into use position such as a power router, tamper and roller assembly.

U.S. Pat. No. 4,005,949 discloses a tamping apparatus tractor type vehicle that can fill and tamp a trench simultaneously. The tamping support is characterized as having a tamping shoe on the end of a reciprocal plunger. A turning rod allows the shoe to rotate horizontally on its own axis.

SUMMARY OF THE INVENTION

A self-contained extensible tamping device removably attached to a support vehicle. The tamping device uses a vibrator attached to a foot support and mount on a vertically and horizontally extensible mounting fixture. Multiple tool heads can be interchanged on the foot support and mount for multiple use configurations.

DESCRIPTION OF THE PREFERRED EMBODIMENT

Figure 1:
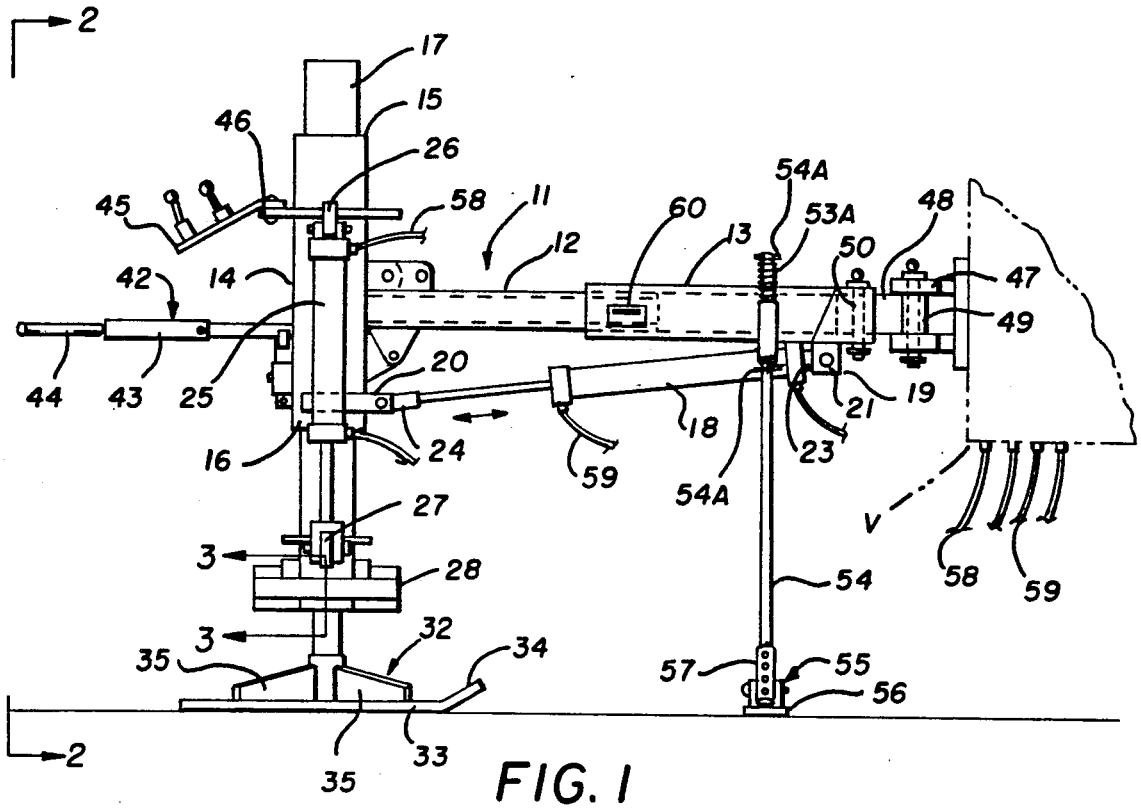
FIG. 1 is a side plan view of the vibrating tamping device.

Referring now to FIG. 1 of the drawings, a vibrating tamping device can be seen having a telescopically extensible support frame 11 comprising a pair of longitudinally extending interconnected tubular frame support elements 12 and 13 positioned partially one within the other. The support tube 12 is removably secured to a vertically extending tubular housing 14 having an upper end 15 and a lower end 16. A support tube 17 is movably positioned within said tubular housing 14 and extends outwardly from said oppositely disposed ends 15 and 16.

A first hydraulic piston and cylinder assembly 18 is pivotally secured from a mounting bracket 19 on said tube support element 13 to a bracket assembly 20 on said vertically extending tubular housing 14. The mounting bracket 19 is of an inverted U-shape having a pair of spaced apertured arms 21 and 22 extending below said tubular element 13. The hydraulic piston and cylinder assembly 18 has apertured mounting lugs 23 and 24 on oppositely disposed respective ends thereof for registration with said respective mounting bracket 19 and said bracket assembly 20 as is well known within the art.

A secondary piston and cylinder assembly 25 is pivotally secured from an apertured mounting lug 26 on said tubular housing 14 to a secondary mounting lug 27 on said support tube 17.

Figure 4:
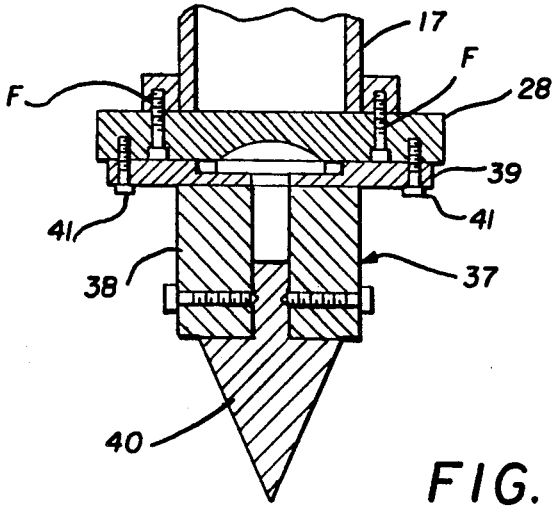
FIG. 4 is an enlarged cross-sectional view of a portion of the device showing the interchangeable fixtures.
Figure 2:
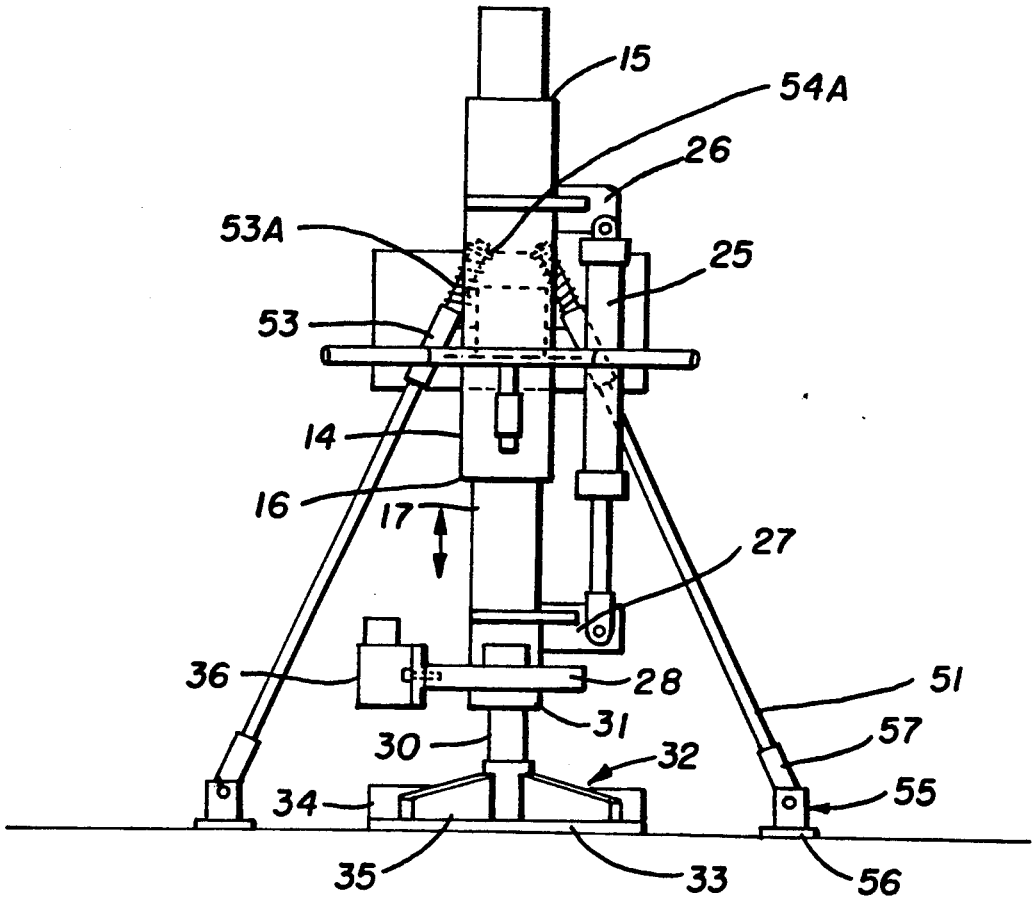
FIG. 2 is a front plan view on lines 2—2 of FIG. 1.
Figure 3:
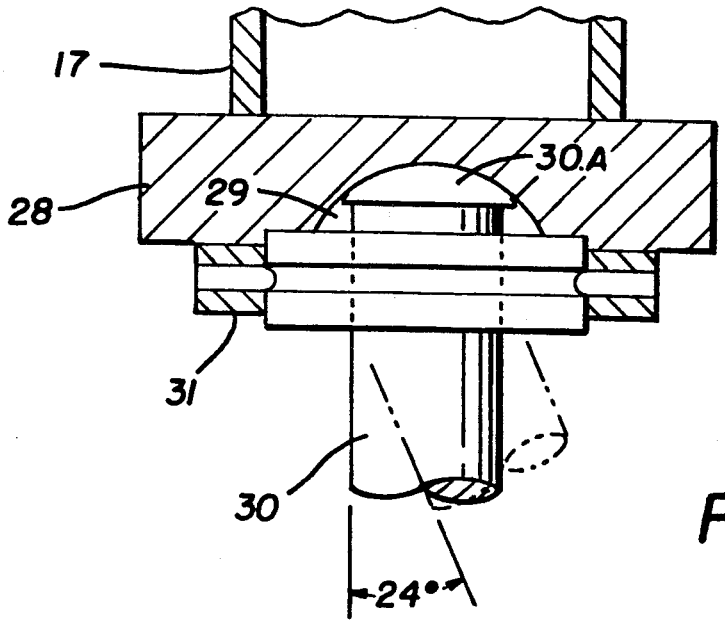
FIG. 3 is an enlarged cross-sectional view on lines 3—3 of FIG. 1.

A tool mounting plate 28 is secured to the end of said support tube 17 by fasteners, best seen in FIG. 4 of the drawings. The tool mounting plate 28 has an arcuate recess portion within at 29 in which an articulated foot support and attachment post 30 is mounted by an apertured mounting fitting 31, best seen in FIG. 3 of the drawings. The support and attachment post 30 has a contoured half-arcuate mushroom shaped end 30A which registers within the recess portion at 29 providing for free 360 degree rotation on its axis and an angular inclination on its longitudinal axis of 24 degrees in any direction.

The attachment post 30 opposite end is registerable within a tamping foot assembly 32 having a generally rectangular ground engagement pad 33 with an angularly inclined edge portion 34. A plurality of reinforcing webs 35 extend radially from a mounting socket in oppositely disposed spaced relation to one another on said engagement pad 33. A vibrator unit 36 is secured to said tool mounting plate 28 to impart a vibratory action to the plate 28 and associated tool fixtures mounted therein. An example of an auxiliary tool fixture can be seen in FIG. 4 of the drawings wherein an auxiliary mounting assembly 37 can be seen having a tool chuck 38, a plate 39 and a pointed tool fixture 40 secured within by fasteners 41.

Figure 5:
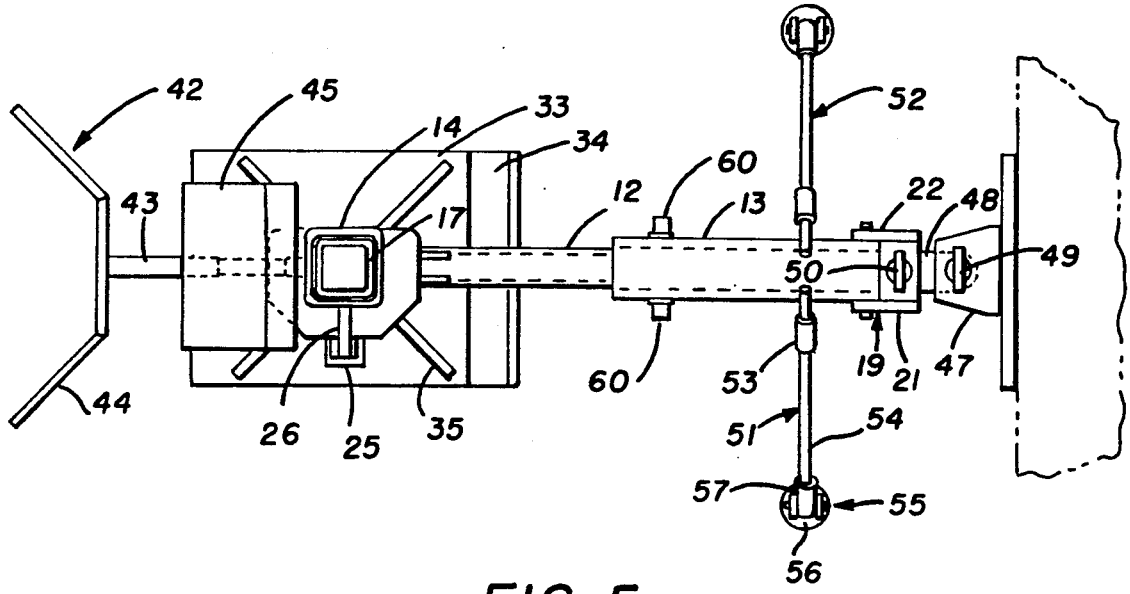
FIG. 5 is a top plan view of the device.
Figure 6:
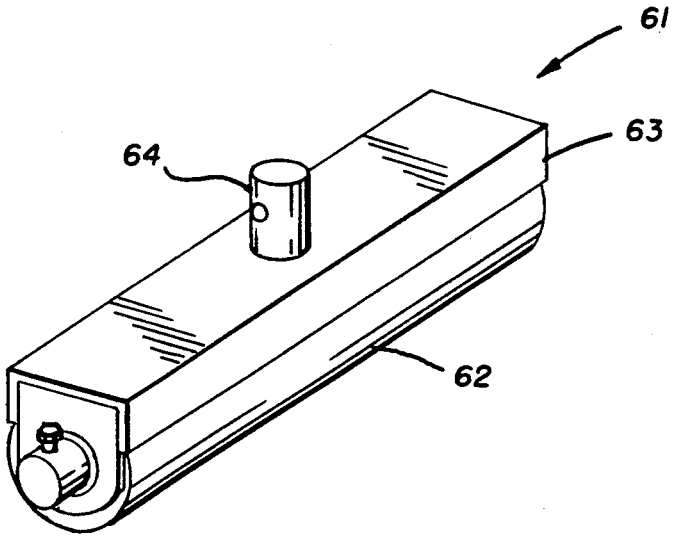
FIG. 6 is an enlarged perspective view of an interchangeable tool fixture represented by a roller assembly.

Referring now to FIGS. 1 and 5 of the drawings, a safety bracket handle assembly 42 can be seen extending outwardly from the tubular housing 14 distance beyond the foot assembly 32. The bracket handle assembly 42 has an adjustable arm 43 from which extends angularly disposed elements 44.

A control panel 45 is mounted on a separate support bracket 46 spaced in vertical relation to the safety handle bracket assembly 42 hereinbefore described.

The support frame 11 is mounted to a vehicle V shown partially in broken lines in FIGS. 1 and 5 of the drawings. An apertured bracket 47 is mounted on the vehicle V for registration with an apertured hitch tongue 48 extending from said free end of said tubular element 13. Pintle pins 49 and 50 extend through aligned apertures in said respective tubular element 13 and the apertured bracket align through the apertures within the hitch tongue allowing for selective removal of the vibrating tamping device from the vehicle V.

The hitch tongue 48 has a tapered end portion allowing for accurate movement of the device in relation to the bracket 47 secured to the vehicle and such movement is denoted by arrows in FIG. 5 of the drawings, affording an increased range of movement to the device.

A pair of adjustable support legs 51 and 52 extend from either side of said tubular element 13 and are comprised of mounting sleeves 53 having a tubular leg 54 extending therefrom. An adjustable foot assembly 55 has a pivoted support pad 56 with an adjustable height collar 57. The support legs 51 and 52 are used to support the device when not in use and removed from the vehicle. The tubular legs are resiliently secured within the mounting sleeve 53 by a spring 53A which is positioned over their free end extending outwardly from the sleeve and held in place by a locking pin 54A.

The legs can be retracted and pivoted upwardly out of the way as indicated by directional arrows and secured to respective clamps 60 as best seen in FIGS. 1 and 5 of the drawings.

In operation, a source of pressurized hydraulic fluid, not shown, such as the vehicle V supplies hydraulic fluid under pressure to said piston and cylinder assemblies via pairs of hydraulic supply lines 58 and 59 as will be well known and understood by those skilled in the art.

The arrangement of the piston and cylinder assemblies combine with the pivoting action of the tongue hitch 48 provides for a wide range of adjustable motion allowing the vibrating tamping device to effectively be used in a number of related work processing modes dependent on the tool insert chosen. Alternate tool fixture inserts can vary from the illustrated tamping foot assembly 32 and tool fixture 40 to, as an example, a compact roller assembly 61 having an elongated roller 62 pivotally secured for rotational movement within a housing 63 and attachment fitting pin 64.

Thus it will be seen that a new and useful vibrating tamping device has been illustrated and described and it will be apparent to those skilled in the art that various changes and modifications may be made therein without departing from the spirit of the invention.

Therefore, I claim:

1. A vibrating tamper device for use on a vehicle comprises in combination a telescopically extensible support frame and housing, a support tube movably positioned within said housing, a vibrating tool plate on the free end of said support tube, means for vibrating said tool plate, a first hydraulic piston assembly pivotally secured between said support frame and said housing, a second hydraulic piston and cylinder assembly pivotally secured between said housing and said support tube, guide end safety means extending from said housing opposite said support frame, a vehicle hitching assembly having a hitch tongue pivotally secured within and extending from said support assembly in said apertured bracket on said vehicle registerable with said hitching tongue, secondary support means on said support frame, means for controlling said hydraulic piston and cylinder assemblies comprising control and supply lines interconnecting said hydraulic piston and cylinder assemblies and a control panel and a source of hydraulic fluid under pressure on said vehicle.

2. The vibrating tamping device of claim 1 wherein said tamping foot assembly comprises a reinforced engagement pad, a post attachment extending from said pad assembly movably positioned within said support plate.

3. The vibrating tamping device of claim 1 wherein said housing is removably secured to said support frame and has spaced multiple mounting lugs engageable with said respective hydraulic piston and cylinder assembly.

4. The vibrating tamping device of claim 1 wherein said secondary support means comprises a pair of oppositely disposed spaced leg assemblies pivotally secured on said support frame inwardly of said hitching assembly.

5. The vibrating tamping device of claim 1 wherein said means for vibrating said tool plate comprises a vibrator motor secured to said tool plate.

6. The vibrating tamping device of claim 1 wherein said second hydraulic piston and cylinder assembly extends said support tube from within said housing imparting selective variable load to said tool plate and respective tool fitting mounted therein.

7. The vibrating tamping device of claim 4 wherein said secondary support leg assemblies are each comprised of a mounting sleeve on said support frame, a tubular leg extending from said sleeve, a foot assembly adjustably positioned on said leg and means for resiliently retaining said leg within said mounting.

8. The vibrating tamping device of claim 7 wherein said means for resiliently retaining said leg within said mounting sleeve comprises a spring positioned over one end of said support leg extending above said support sleeve and retained by multiple pins above and below said support sleeve through said tubular support leg.

* * * * *